US006672521B2

(12) United States Patent
Reichler

(10) Patent No.: US 6,672,521 B2
(45) **Date of Patent: *Jan. 6, 2004**

(54) HIGH-SPEED ROTATION ATOMIZER FOR APPLICATION OF POWDER PAINT

(75) Inventor: Jan Reichler, Constance (DE)

(73) Assignee: Eisenmann Lacktechnik KG (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/168,835

(22) PCT Filed: Oct. 2, 2001

(86) PCT No.: PCT/EP01/11362

§ 371 (c)(1),
(2), (4) Date: Jun. 21, 2002

(87) PCT Pub. No.: WO02/34410

PCT Pub. Date: May 2, 2002

(65) Prior Publication Data

US 2003/0001032 A1 Jan. 2, 2003

(30) Foreign Application Priority Data

Oct. 27, 2000 (DE) ..... 100 53 292

(51) Int. Cl.[7] ..... B05B 5/00
(52) U.S. Cl. ..... 239/703; 239/705; 239/700
(58) Field of Search ..... 239/697–708

(56) References Cited

U.S. PATENT DOCUMENTS 3,826,425 A * 7/1974 Scharfenberger et al. ..... 239/15
4,302,481 A * 11/1981 Ribnitz et al. ..... 239/704
4,499,118 A * 2/1985 Dietz et al. ..... 427/28
4,788,933 A * 12/1988 Buschor ..... 239/698
4,844,348 A * 7/1989 Rutz ..... 239/703
5,400,976 A * 3/1995 Kaijyu et al. ..... 239/704
6,045,053 A * 4/2000 Ruud ..... 239/700

FOREIGN PATENT DOCUMENTS

GB 2066701 * 7/1981
WO WO 96/36438 * 5/1996

* cited by examiner

*Primary Examiner*—Michael Mar
*Assistant Examiner*—Dinh Q. Nguyen
(74) *Attorney, Agent, or Firm*—Factor & Partners

(57) ABSTRACT

A high-speed rotary atomizer for applying powder coating comprises in a known manner a housing (1), in which a motor (13) is accommodated. The motor (13) rotates a bell-shaped plate (16) which is disposed at the front of the housing (1). At least one powder supply duct (28, 29, 22, 23, 24, 25, 11, 12, 9, 10) leads through the housing and opens at the front of the housing (1). Its cross section can therefore be kept very large, thereby increasing the powder output of the high-speed rotary atomizer. This also enables a plurality of powder supply ducts (28, 29, 22, 23, 24, 25, 11, 12, 9, 10) to be laid, which in turn results in a higher powder throughput and improved homogeneity of the powder cloud which is produced.

8 Claims, 2 Drawing Sheets

HIGH-SPEED ROTATION ATOMIZER FOR APPLICATION OF POWDER PAINT

The invention relates to a high-speed rotary atomizer for applying powder coating, with a housing; with a rotatable bell-shaped plate which is disposed at the front of the housing; with a motor which is accommodated in the housing and drives the bell-shaped plate, and with at least one powder supply duct which extends through the housing and emerges at the front of the housing.

The powder supply duct of known high-speed rotary atomizers of this type which are currently on the market leads through the hollow shaft of the motor and opens out at the front very near the axis of the bell-shaped plate. This arrangement entails two disadvantages: Firstly, the cross section of the powder supply duct may only be relatively small, which limits the powder throughput and thus the coating performance of the high-speed rotary atomizer. Secondly, the coating powder is brought into the range of action of the high-speed rotary atomizer very near the axis, where the speed of the atomizer is relatively low. This impairs the efficiency of the vorticity which is achieved by the bell-shaped plate.

The object of the invention is to provide a high-speed rotary atomizer of the type initially mentioned whose coating performance is significantly better.

This object is achieved according to the invention in that the powder supply duct leads through the housing radially outside of the motor.

Therefore, according to the invention, the supply of powder to the bell-shaped plate through the housing no longer takes place through the hollow shaft of the motor. The entire motor is instead "bypassed" by the powder supply duct. The duct may thus be laid through a region of the housing in which there is sufficient space for large cross sections. The powder throughput is therefore no longer limited by geometric conditions.

The configuration according to the invention may also comprise a plurality of powder supply ducts without any problems. It is in this case particularly advisable to provide a configuration in which a plurality of powder supply ducts are disposed radially outside of the motor in corresponding multidentate rotational symmetry. This achieves not just a very high powder throughput, but also very satisfactory homogeneity of the powder cloud which is produced.

The powder supply duct may be formed at the interface between two parts, at least in one portion. The advantage of this lies in the fact that the inner surface of this region of the powder supply duct is immediately accessible and can be cleaned when the two parts are disassembled.

It is in this respect particularly preferable for the two said parts to be the housing on the one hand and a housing insert on the other.

The use of high-speed rotary atomizers with so-called "internal charging" has recently increased. This term means that the high-voltage electrode by means of which the powder coating particles are ionized is located inside the housing of the high-speed rotary atomizer.

"Internal charging" is contrary to "external charging", where the high-voltage electrode is generally provided as a ring, which surrounds the bell-shaped plate, outside of the housing. In the case of "external charging", the air surrounding the outer electrode is firstly ionized, after which the coating powder is indirectly ionized via the latter, this having a relatively poor efficiency. In the case of "internal charging", however, the coating powder particles are ionized through direct contact with the high-voltage electrode, this taking place more efficiently.

If, therefore, the inventive concept is employed with high-speed rotary atomizers with internal charging, it is particularly advantageous to connect the housing insert, which partly defines the powder supply duct, as a high-voltage electrode. The coating powder is thus brought over a considerable distance through the housing into contact with a surface carrying a high voltage. This results in a very good ionization effect.

The housing and at least one housing insert may be of a conical formation in the front region and lie against one another with cone faces. This mechanical structure facilitates assembly and disassembly of the high-speed rotary atomizer, as the housing and the housing insert can be fixed in one direction by fitting the conical regions into one another and only require a fastening device at the opposite end.

It is preferable in this case for the cone faces of the housing and of the housing insert to be self-sealing and/or self-locking. This also facilitates assembly; special sealing means are unnecessary.

The shaft of the motor which drives the bell-shaped plate generally has air bearings. An air bearing bush, in which the shaft of the motor is guided, is provided for this purpose. Bearing air is forced radially inwards through small ducts in the air bearing bush and thus forms an air cushion between the inner surface area of the air bearing bush and the outer surface area of the shaft. If an air bearing arrangement of this kind is used in the present invention, it is particularly advantageous for the shaft of the motor to be hollow and comprise radial bores via which the bearing air can pass into the interior space of the shaft, and for the interior space of the shaft to communicate with a through-bore in the bell-shaped plate which opens into the end side of the bell-shaped plate. According to the invention, the shaft is no longer required for supplying powder; it can now be used for other purposes, i.e. for supplying cleaning air to the bell-shaped plate for blowing off adhesions at this point. In this configuration of the invention the bearing air is supplied for a second purpose: Because it can enter the hollow shaft of the motor and be supplied via this to the bell-shaped plate, it does not emerge unused, as was previously the case, instead additionally performing the cleaning function.

An embodiment of the invention is illustrated in detail in the following on the basis of the drawings, in which.

Figure 1:
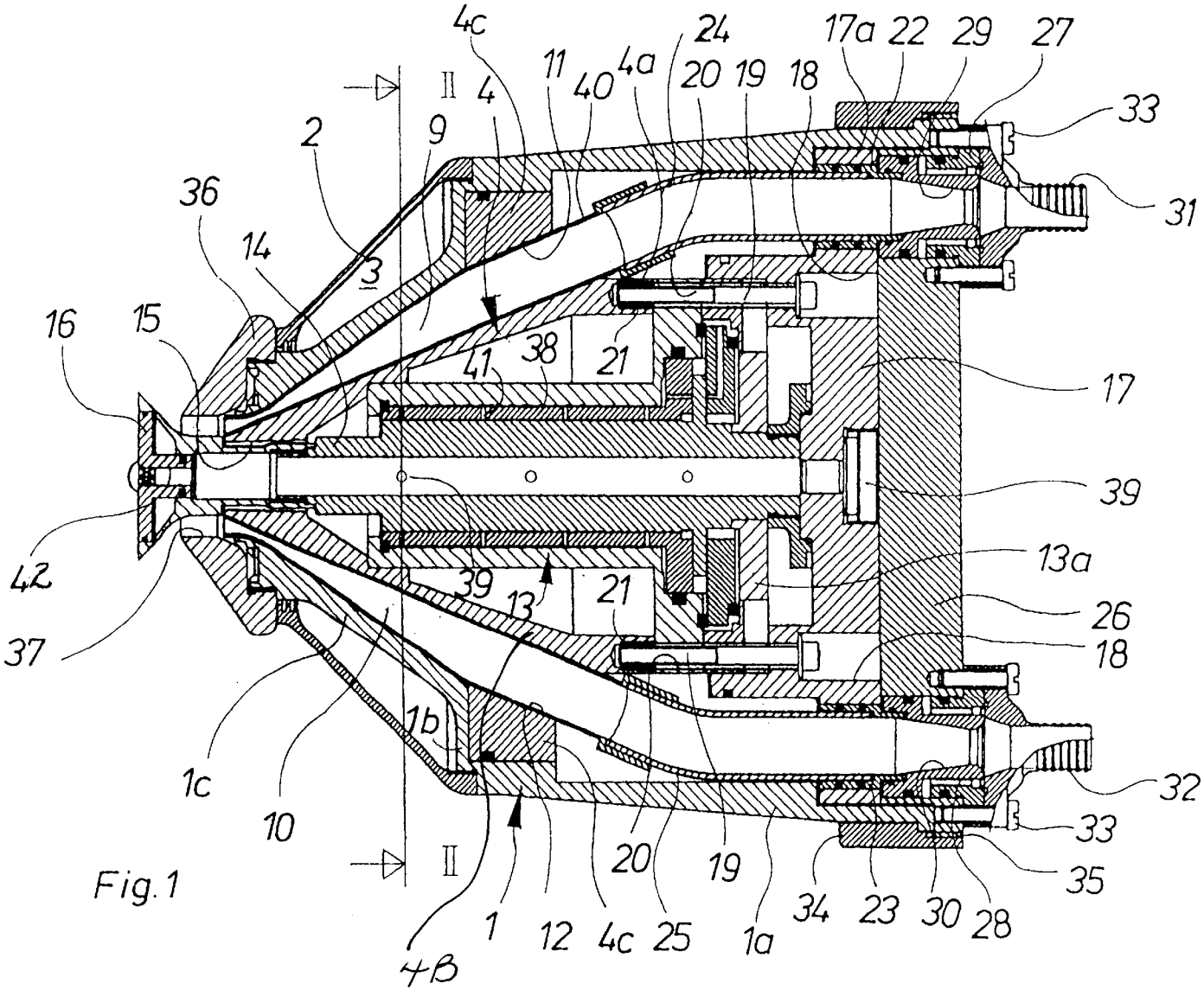
FIG. 1 is an axial section through a high-speed rotary atomizer.

The high-speed rotary atomizer which is represented in FIG. 1 comprises a housing 1, which is composed in one piece of a rear housing portion 1*a,* a radially extending annular shoulder 1*b* and a front housing portion 1*c*. The rear housing portion 1*a* widens with a small cone angle in the direction of the back of the high-speed rotary atomizer; the front housing portion 1*c* is also conical, although the cone angle is greater than that of the rear housing portion 1*a*. The housing 1 consists entirely of a plastics material.

An annular part 2, which is likewise conical and likewise made of a plastics material, extends from the radially outer edge of the step 1*b* of the housing to the front region of the outer surface area of the front housing portion 1*c*. The annular part 2 is sealed off from the housing 1 at both circular edges, so that it encloses with the housing 1 an annular space 3. This serves—in a way which is not of interest here—for the passage of guiding air, by means of which the shape of the powder cloud which is produced can be influenced.

An electrode insert 4 is disposed coaxially inside the housing 1, which insert comprises a circular cylindrical rear region 4*a*, which is relatively short in the axial direction, and a conical front region 4*b*. The front region 4*b* of the electrode insert 4 ends in the vicinity of the front end of the front housing portion 1*c*.

Figure 2:
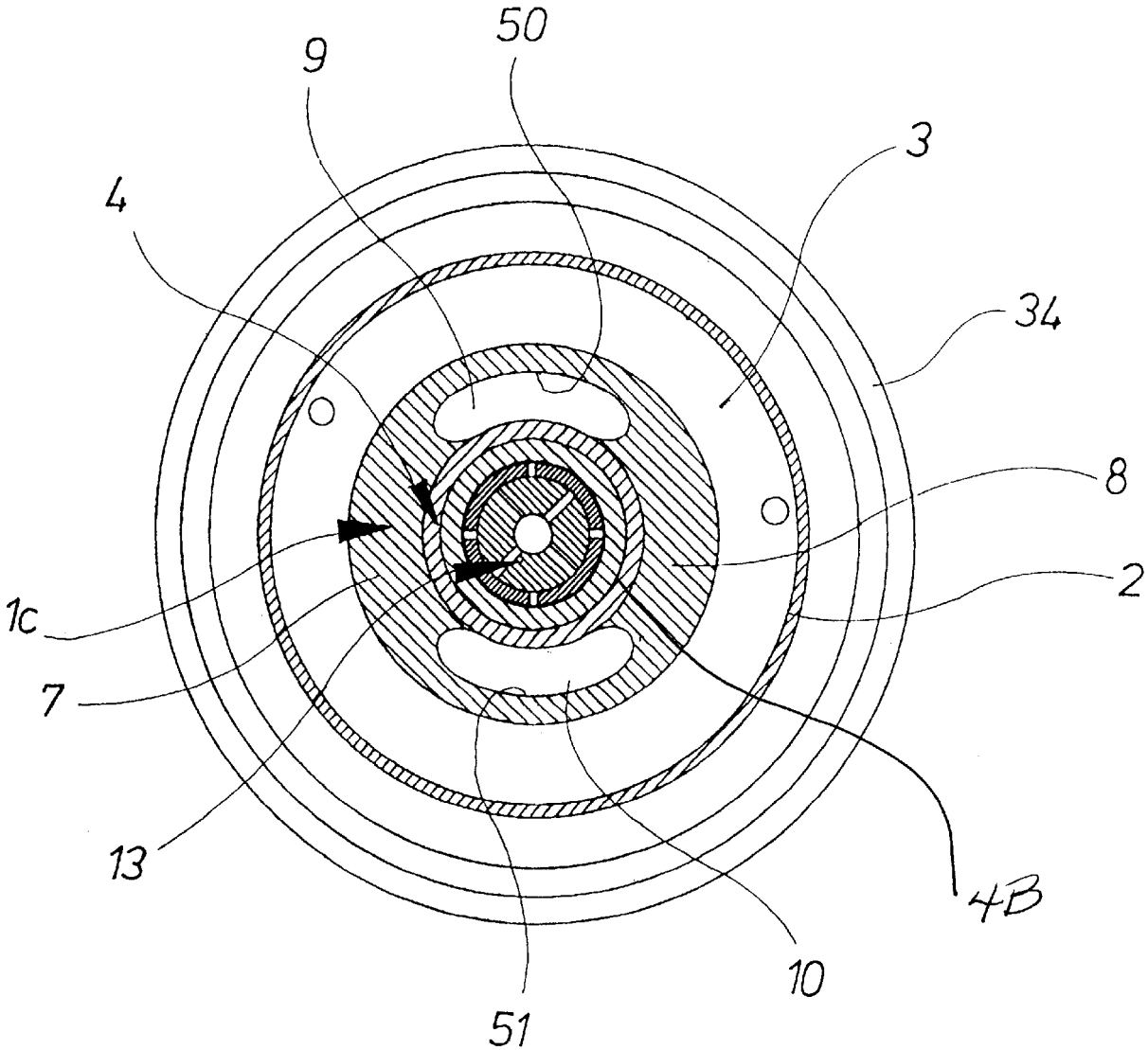
FIG. 2 is a section through the high-speed rotary atomizer of FIG. 1 according to the line II—II in the latter.

As shown by FIG. 2, two specularly symmetrical recesses 50, 51 are disposed at the inner surface area of the front housing portion 1*c*, which recesses extend from the back of the step 1*b* to the front end of the front housing portion 1*c* and in so doing pass from an approximately circular cross-sectional shape into the cross-sectional shape of circular arc-shaped gaps. As illustrated by FIG. 2, the conical inner surface area of the front housing portion 1*c* lies via two webs 7, 8 against the conical surface area of the front portion 4*b* of the electrode insert 4. The front portion 4*b* of the electrode insert 4 and the front housing portion 1*c* thus form two ducts 9 and 10. These ducts 9, 10 are inclined with respect to the common axis of the housing 1 and the electrode insert 4 such that they converge in the direction of the front end of the high-speed rotary atomizer.

A radially extending flange 4*c* is moulded onto the electrode insert 4 approximately in the transition region between the front region 4*b* and the rear region 4*a*, which flange extends parallel to the annular shoulder 1*b* of the housing 1, lying against the inside thereof. Two recesses 11, 12, which continue the ducts 9, 10, pass through the annular flange 4*c*.

An air-driven motor 13 is inserted in the appropriately stepped interior space of the electrode insert 4, the shaft 14 of which motor extends coaxially with the housing 1 and with the electrode insert 4 and passes through a through-bore 15 in the electrode insert 4. The hub of a bell-shaped plate 16 is locked onto the shaft 14 such that the bell-shaped plate 16 rotates together with the shaft 14.

The motor 13 is fixed by means of a region 13*a* of a greater radius to the electrode insert 4. This is effected by clamping the motor region 13*a* between the rear end side of the electrode insert 4 and a pot-shaped holding insert 17. For this purpose the holding insert 17 comprises stepped bores 18, through which screws 19 are led. These screws 19 pass through through-bores 20 in the motor portion 13*a* and are screwed into threaded bores 21 in the electrode insert 4.

Two connection bushes 22, 23 are led through a radially protruding flange region 17*a* of the holding insert 17. The rear end of a connecting tube 24, 25 is in each case fastened to the connection bushes 22, 23, which tube is connected at its front end to a beryllium sleeve 40 (FIG. 1), which passes through the through-bore 11 and 12, respectively, in the flange portion 4*c* of the electrode insert 4 as well as the ducts 9, 10 and lies against the inner surfaces thereof. This seals off the powder flow paths. It is alternatively also possible to dispense with this sleeve 40, as represented in FIG. 2.

The rear end of the housing 1 is closed by a connection plate 26, which lies against the back of the holding insert 17, bears various air connections, not represented in the drawings, and also serves for fastening to the arm of a robot, which is not represented either. Two acceleration nozzle inserts 27, 28 extend coaxially with the connection bushes 22, 23 in the holding insert 17 through the connection plate 26. The exact function of these inserts is not of interest in this connection; their through-openings 29 and 30, respectively, are each aligned with the through-opening in the adjacent connection bush 22 and 23, respectively.

A respective connection nipple 31, 32 is mounted on the rear end side of the acceleration nozzle inserts 27, 28, again in alignment, this nipple being used for connection to a flexible tube, via which the powder is supplied from a reservoir. The connection nipples 31 and 32 as well as the acceleration nozzle inserts 27, 28 are fastened by screws 33 to the connection plate 26 such that, having loosened the screws 33, the connection nipples 31, 32 can firstly be removed, after which the acceleration nozzle inserts 27, 28 can be withdrawn from the connection plate 26.

The connection plate 26 is retained at the housing 1 by means of a cap nut 34, which abuts against a circumferential step of the housing 1 and is screwed onto an external thread 35 of the connection plate 26.

The high-speed rotary atomizer can be mounted as follows:

The motor 13 is firstly inserted in the interior space of the electrode insert 4, where it is secured by means of the holding insert 17. The connection bushes 22, 23 which are inserted in the flange region 17*c* of the holding part 17 are connected via the tubes 24, 25 to the through-bores 11, 12 in the flange portion 4*c* of the electrode insert 4. The unit which is thus formed is now pushed into the housing 1 until the conical surface area of the portion 4*b* lies against the webs 7, 8, which likewise extend conically, of the inner surface area of the housing 1. The cone angle may in this case be selected so as to produce a kind of self-locking and sealing effect like "Morse tapers".

The connection plate 26 is finally mounted on the rear end side of the holding insert 17, closing the housing 1, as represented in FIG. 1, and fastened in this position by means of the cap nut 34.

The high-speed rotary atomizer is disassembled in a corresponding, reverse manner. The surfaces which define the ducts 9 and 10 can in this respect very easily be exposed for cleaning.

An air guide body 36, which is of no interest in this connection, is mounted on the front end of the housing 1. This body comprises a through-bore 37, which surrounds the hub of the bell-shaped plate 16 at a spacing.

As shown by the section of the FIG. 1, the shaft 14 of the air-driven motor 13 is hollow. It is mounted in a bearing bush 38, which comprises a plurality of very fine, radially directed through-bores 41. The hollow shaft 14 is also provided with a plurality of radial bores 39. Its rear end, i.e. the right-hand end in FIG. 1, is closed by a closure body 39. However its front end, which is the left-hand end in FIG. 1, communicates with a through bore 42 in the bell-shaped plate 16, which bore opens into the front end face of the plate.

The radially outer side of the bearing bush 38 is subjected to compressed air. This compressed air penetrates the small radial through-bores 41 in the bearing bush 38 and in the first place provides a bearing air cushion between the bearing bush 38 and the motor shaft 14. The bearing air then passes through the radial bores 39 in the motor shaft 14 and is routed in the interior space thereof to the front end and therefore to the through-bore 40 in the bell-shaped plate 16. The bell-shaped plate 16 is freed from adhesions when this air emerges at the front end side of the plate.

The described high-speed rotary atomizer functions as follows:

The coating powder which is supplied via the connection nipples 31, 32 is firstly accelerated in the accelerator nozzle inserts 27, 28, for reasons which are of no further interest here, and then introduced via the tubes 24, 25 into the sleeves 40 passing through the through-bores 11, 12 and the ducts 9, 10. In so doing the coating powder sweeps along metallic surfaces, which are electrically connected to the electrode insert 4, and is directly ionized. It now emerges in this ionized form through the two arcuate exit gaps lying between the front end of the housing 1 and the front end of the electrode insert 4, passes through the through-bore 37 in the air guide body 36 and is then spun by the rotating bell-shaped plate 16. The shape of the powder cloud which is thus produced is influenced by a guide air stream which is routed along the outer surface area of the air guide body 16 in a fashion which is not described here.

The described high-speed rotary atomizer therefore comprises two powder supply ducts, which are each formed by an accelerator nozzle insert 27, 28, a tube 24, 25 and a sleeve 40, which passes through a through-bore 11, 12 in the flange 4*c* of the electrode insert 4 and a duct 9, 10 between the housing 1 and the electrode insert 4. The eccentric routing of the powder supply ducts permits large flow cross sections to be implemented, so that high powder outputs can be achieved. The powder may also be directed past large electrode surfaces, so that good ionization can be achieved.

What is claimed is:

1. A high-speed rotary atomizer for applying powder coating, with a housing; with a rotatable bell-shaped plate which is disposed at the front of the housing; with a motor which is accommodated in the housing and drives the bell-shaped plate, and with a plurality of powder supply ducts which extend through the housing and emerge at the front of the housing, characterized in that the powder supply ducts lead through the housing radially outside of the motor, and are disposed radially outside of the motor in corresponding multidentate rotational symmetry, wherein the plurality of powder supply ducts lead to arc-shaped gaps at the front side of the housing.

2. The high-speed rotary atomizer according to claim 1, characterized in that the powder supply ducts are formed at an interface between two parts, at least in a first portion.

3. The high-speed rotary atomizer according to claim 1, characterized in that the powder supply ducts are formed at an interface between the housing and a housing insert.

4. The high-speed rotary atomizer according to claim 3, in which a high-voltage electrode is provided in the housing for internally charging the coating powder, characterised in that the housing insert consists of metal and is connected as a high-voltage electrode.

5. The high-speed rotary atomizer according to claim 1, characterised in that the housing and at least one housing insert are of a conical formation in the front of the housing and lie against one another with cone faces.

6. The high-speed rotary atomizer according to claim 5, characterised in that the cone faces of the housing and of the housing insert are at least one of self-sealing and self-locking.

7. The high-speed rotary atomizer according to claim 1, in which the motor includes a shaft having an interior space, wherein the shaft of the motor is guided in an air bearing bush, charaterised in that the shaft of the motor is hollow and comprises radial bores, via which the bearing air can pass into the interior space of the shaft, and that the interior space of the shaft communicates with a through-bore in the bell-shaped plate which opens into the end side of the bell-shaped plate.

8. A high-speed rotary atomizer for applying powder coating, with a housing and at least one housing insert; with a rotatable bell-shaped plate which is disposed at the front of the housing; with a motor which is accommodated in the housing and drives the bell-shaped plate, and with at least one powder supply duct which extends through the housing and emerges at the front of the housing, characterized in that the powder supply duct leads through the housing radially outside of the motor, and the housing and the at least one housing insert are of a conical formation in the front of the housing and lie against one another with cone faces, wherein the cone faces of the housing and of the housing insert are at least one of self-sealing and self-locking.

* * * * *